US008942983B2

(12) United States Patent
Khitrov

(10) Patent No.: US 8,942,983 B2
(45) Date of Patent: Jan. 27, 2015

(54) METHOD OF SPEECH SYNTHESIS

(75) Inventor: Mikhail Vasilievich Khitrov, Saint Petersburg (RU)

(73) Assignee: Speech Technology Centre, Limited (RU)

( * ) Notice: Subject to any disclaimer, the term of this patent is extended or adjusted under 35 U.S.C. 154(b) by 509 days.

(21) Appl. No.: 13/303,174

(22) Filed: Nov. 23, 2011

(65) Prior Publication Data

US 2012/0072224 A1 Mar. 22, 2012

Related U.S. Application Data

(63) Continuation-in-part of application No. PCT/RU2010/000441, filed on Aug. 9, 2010.

(51) Int. Cl.
*G10L 13/08* (2013.01)

(52) U.S. Cl.
USPC ..... 704/260; 704/258; 704/261

(58) Field of Classification Search
USPC ..... 704/258, 260, 261, 266, 9, 257, 267, 704/270
See application file for complete search history.

(56) References Cited

U.S. PATENT DOCUMENTS

| | | | | |
|---|---|---|---|---|
| 4,829,573 | A * | 5/1989 | Gagnon et al. | 704/261 |
| 6,665,641 | B1 | 12/2003 | Coorman et al. | |
| 7,502,739 | B2 | 3/2009 | Saito et al. | |
| 2004/0148171 | A1 * | 7/2004 | Chu et al. | 704/258 |
| 2005/0114137 | A1 * | 5/2005 | Saito et al. | 704/260 |
| 2008/0294443 | A1 | 11/2008 | Eide | |

FOREIGN PATENT DOCUMENTS

| | | |
|---|---|---|
| WO | 9819297 | 5/1998 |
| WO | 0126091 | 4/2001 |
| WO | 2008147649 | 12/2008 |

* cited by examiner

*Primary Examiner* — Huyen X. Vo

(57) ABSTRACT

The present invention relates to a method of text-based speech synthesis, wherein at least one portion of a text is specified; the intonation of each portion is determined; target speech sounds are associated with each portion; physical parameters of the target speech sounds are determined; speech sounds most similar in terms of the physical parameters to the target speech sounds are found in a speech database; and speech is synthesized as a sequence of the found speech sounds. The physical parameters of said target speech sounds are determined in accordance with the determined intonation. The present method, when used in a speech synthesizer, allows improved quality of synthesized speech due to precise reproduction of intonation.

14 Claims, 1 Drawing Sheet

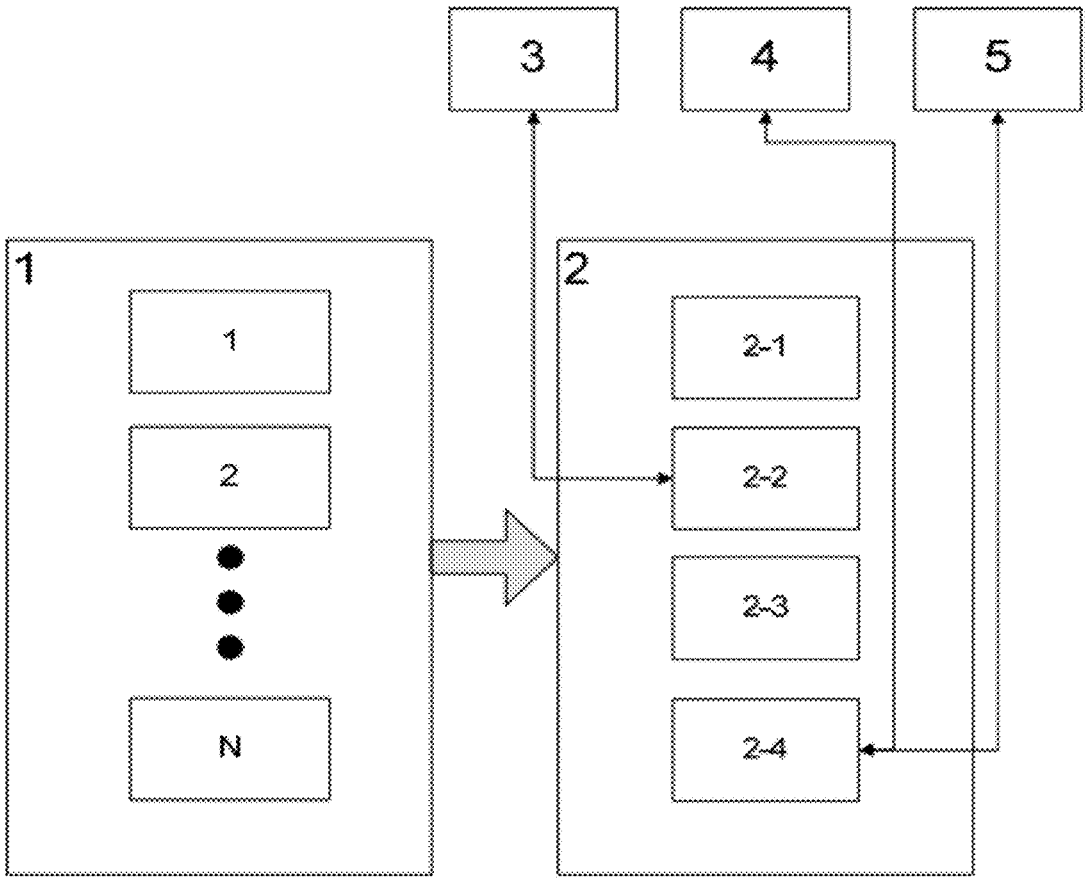
3
4
5
1
1
2
N
2
2-1
2-2
2-3
2-4

METHOD OF SPEECH SYNTHESIS

CROSS-REFERENCE TO RELATED APPLICATION

This application is a continuation-in-part of International Application PCT/RU2010/000441 filed on Aug. 9, 2010 which claims priority benefits from Russian patent application RU 2009131086 of Aug. 7, 2009. The content of these applications is hereby incorporated by reference in its entirety.

TECHNICAL FIELD

The present invention generally relates to methods of speech synthesis and in particular to compilation text-based methods of speech synthesis

BACKGROUND OF THE INVENTION

Speech synthesis devices are widely used in various fields. In particular, these devices can be used in automated inquiry and service systems, e.g. for providing information, reservation, notification, etc.; in call center and ordering systems; in voice commentary systems; in auxiliary and adaptive systems for blind and visually impaired persons, as well as for other categories of persons with disabilities; in developing voice portals; in education; in TV projects and advertisement projects, e.g. to produce presentations; in document preparation systems and editorial publication systems; in electronic phone secretaries; in multimedia and entertainment projects and in other fields.

The most widespread approach to speech synthesis is the compilation approuch, which provides the highest degree of similarity of synthesized speech to natural speech. According to compilation methods, synthesized speech based on user-defined text is produced by connecting units of pre-recorded natural speech of different length.

Historically, the first electronic synthesis systems were systems synthesizing speech from phonemes. Herein, the term "phoneme" refers to the smallest segmental unit of a language which has no individual vocabular or grammatical meaning. Said systems did not require large database capacity because the number of phonemes in any given language does not usually exceed several dozens. For example, according to various phonological schools, the Russian language contains from 39 to 43 phonemes. However, due to a variety of phoneme combinations coarticulation boundary effects at phoneme junctions should be taken into account when synthesizing text from phonemes. In order to account for such effects, a wide variety of coarticulation rules were used, but even in that case the speech produced by using such systems was of a low quality compared with natural speech.

Further studies carried out to solve the problems of coarticulation led to the development of systems synthesizing speech from larger units. In particular, various diphonic synthesis systems were developed. Herein, the term "diphone" refers to a section of speech between centers of adjacent phonemes. This approach required larger databases of 1500-2000 units. The clear advantage of diphonic synthesis compared with phonemic synthesis is the fact that a diphone contains all information defining the transition between two adjacent phonemes. However, a significant number of connection points (one for each diphone) led to the necessity of using complex smoothing algorithms to synthesize speech of acceptable quality. Furthermore, due to the fact that only one variation of each diphone was usually stored in the database, synthesized speech did not provide prosodic variability, and thus it was necessary to use sound duration and sound pitch control techniques to provide intonation tones.

Another approach for taking into account coarticulation effects is in using syllables as units for speech synthesis. The advantage of this solution is that most coarticulation effects occur within syllables rather than at their ends. Thanks to this syllable-by-syllable synthesis systems allow better quality of synthesized speech compared with aforementioned systems. However, due to a large number of syllables in language, syllable-by-syllable synthesis requires a substantial increase in database capacity. In order to decrease the amount of stored data, a half-syllabic synthesis (i.e. synthesis based on half-syllables produced by dividing syllables along their core) was used. However, this automatically led to more complicated connection of speech units in synthesis.

All aforementioned systems synthesized uniform speech with no intonation variability, because they had only one or just a few candidates for each synthesized speech sound due to limited database capacity and computational capability. In order to give synthesized speech an emotional overtone, various techniques of changing duration and pitch of speech sounds were used, however, the quality of such speech was insufficient. On the other hand, a relatively short length of speech units of natural speech used for synthesis resulted in a large number of connection points, and therefore, the necessity to use various smoothing and/or coarticulation techniques, which, on the one part, made synthesis systems more complicated, and, on the other part, did not allow the use of database elements without processing, making the synthesized speech sound less natural.

As computational devices grew in memory capacity and processing capability, it became possible to use larger databases containing continuous and non-uniform speech samples, and thus use longer and more diverse speech units, which provides increased quality of synthesized speech due to fewer connection points and intonation saturation of units used.

In WO 0126091, a method for producing a viable speech rendition of text is disclosed. According to this method, the text to be processed is split into words which are then compared with a list of words previously saved in a database as audio files. If a corresponding audio file is found for each word in the text, the speech is synthesized as a sequence of audio files including all words of the text. If, however, a corresponding audio file is not found for some words, such words are split into diphones and the desired word is produced by concatenating corresponding diphones which are also previously saved in the database. The advantage of said method is the use of relatively large speech units (i.e. words) for speech synthesis thus decreasing the number of connection points and making synthesized speech smoother. On the other hand, using a combination of corresponding diphones instead of words makes it possible to limit the database to only common enough words, thus allowing limitation of the database capacity. However, said approach does not provide synthesized speech comparable with natural speech in terms of quality. That is due to the fact that the database usually contains only one neutral pronunciation sample for each word, whele, in natural speech, a word can sound differently depending on its position within a sentence and intonation. This problem is marginally solved by recording additional variations of pronunciation of words into the database corresponding to their terminal position within a sentence. However, this method is in large incapable of synthesizing non-uniform speech with intonation overtones.

In recent years, developers of speech synthesis methods from user-defined text and corresponding synthesis devices have been focused on making synthesized speech more natural by providing it with prosodic flexibility and intonation overtones.

In the U.S. Pat. No. 6,665,641, variations of speech synthesizer are disclosed, the synthesizer comprising, for example, a speech database including speech waveforms; a speech waveform selector in communication with said database; and a speech waveform concatenator in communication with said database. Said selector searches for speech waveforms in the database based on certain criteria. Such criteria may be, for example, similarity in linguistic and prosodic attributes, wherein candidate sound waveforms are of a pitch within the range defined as a function of high-level linguistic features. Then said concatenator concatenates selected speech waveforms to obtain an output speech signal. This speech synthesizer provides speech based on previously recorded speech units while reproducing various prosodic attributes, however, the speech synthesizer does not take into account that physical parameters of a speech waveform are dependent from the intonation of the initial text and its parts, which does not allow precise reproduction of intonation of the speech.

In WO 2008147649, a method for synthesizing speech is disclosed. The method uses speech microsegments as speech units for synthesis. According to said method, an input text sequence is processed to obtain acoustic parameters. Then a number of candidate speech microsegment sets are selected from a speech database in accordance with the obtained acoustic parameters and a preferred sequence of speech microsegments for the obtained acoustic parameters is determined. Speech is synthesized from these speech microsegments. The duration of said microsegments can be no more than 20 ms, i.e. several times shorter than, for example, the duration of a diphone. It allows more frequent acoustic variations in the synthesized speech compared with phonemic and diphonic synthesis thus making the speech more natural. Several methods of obtaining the acoustic parameters based on processing the input text are disclosed in the application, however, the application also fails to disclose any mechanism of direct association between said parameters and intonation and finally does not provide synthesized speech with desired intonation overtones.

A closest prior art of the claimed invention is U.S. Pat. No. 7,502,739, disclosing a speech synthesis apparatus for synthesizing speech from a text and using a method of speech synthesis, comprising:

specifying at least one portion of a text;

determining the intonation of each portion;

associating target speech sounds with each portion;

determining physical parameters of the target speech sounds;

finding speech sounds most similar to the target speech sounds in terms of the physical parameters in the database;

synthesizing speech as a sequence of the found speech sounds.

According to this method, intonation models are additionally determined, intonation patterns corresponding to said models are found in an intonation pattern database and the found patterns are concatenated to produce an intonation pattern of the whole text. Then speech are synthesized based on said intonation pattern of the whole text.

The method of U.S. Pat. No. 7,502,739 allows a wide variability of intonation and speech overtones depending on fullness of the intonation pattern database. However, according to said method, the intonation of synthesized speech is a result of processing speech units by an intonation pattern and further concatenating the speech units to produce speech corresponding to the input text, which may worsen the natural sounding of the synthesized speech.

Therefore, despite developing a plurality of methods, devices and systems for compilation speech synthesis from user-defined text using different solutions to reproduce prosodic and intonation peculiarities, the problem of speech synthesis with improved intonation reproduction remains actual.

BRIEF SUMMARY OF THE INVENTION

The object of the present invention is to provide a method of text-based speech synthesis with improved quality of synthesized speech by means of precise reproduction of intonation.

The object is achieved by providing a method of text-based speech synthesis, wherein:

at least one portion of a text is specified;

the intonation of each portion is determined;

target speech sounds are associated with each portion;

physical parameters of the target speech sounds are determined;

speech sounds most similar to the target speech sounds in terms of said physical parameters are found in a speech database;

speech is synthesized as a sequence of the found speech sounds, characterized in that the physical parameters of said target speech sounds are determined in accordance with specific intonation.

Thus, according to the proposed method, the physical parameters of the target speech sounds are determined in accordance with speech intonation, in contrast to taking said intonation into account when synthesizing already selected sounds. In other words, the speech intonation is taken into account at the search stage rather than at the synthesis stage, which makes it possible to find the most suitable sounds for synthesis in the speech database, minimize or eliminate the need for further processing of the produced speech, and thus make said speech more natural with an improved intonation reproduction.

In another embodiment of the invention, linguistic parameters of the target speech sounds are further determined and when the speech sounds are searched for in the speech database, speech sounds most similar to the target speech sounds also in terms of said linguistic parameters are found in the speech database.

In another embodiment of the invention, the linguistic parameters of a speech sound include at least one of the following parameters: transcription; speech sounds preceding and following said speech sound; the position of said speech sound with respect to the stressed vowel.

In still another embodiment of the invention, the at least one portion of a text is specified based on grammatical characteristics of words in the text and punctuation in the text.

In another embodiment of the invention, at least one preconstructed intonation model is selected according to the determined intonation, said model being defined by at least one of the following parameters: inclination of the trajectory of the fundamental pitch, shaping of the fundamental pitch on stressed vowels, energy of speech sounds and law of duration variation of speech sounds, and the physical parameters of the target speech sounds are determined based on at least one of said parameters of corresponding model.

In another embodiment of the invention, shaping of the fundamental pitch on stressed vowels includes shaping on the first stressed vowel and/or middle stressed vowel and/or last stressed vowel.

In another embodiment of the invention, said physical parameters of speech sounds include at least duration of speech sounds, frequency of the fundamental pitch of speech sounds and energy of speech sounds.

In still another embodiment of the invention, the most similar sounds are determined by calculating the value of at least one function defining the difference in physical and/or linguistic parameters of the target sound and a sound from the speech database, and/or by calculating the value of at least one function for each sound from the speech database which can be used in synthesis, said function characterizing the attributes of this sound, and/or by calculating the value of at least one function for each pair of sounds from the sound database which can be used in synthesis of each subsequent pair of the target sounds, said function defining the quality of connection between said pair of sounds from the speech database.

Said most similar sounds are determined as speech sounds forming a sequence to synthesize a predetermined fragment of said text, for which sequence the sum of calculated values of said functions is minimal.

In another embodiment of the invention, the predetermined fragment of the text is a sentence or a paragraph.

In another embodiment of the invention, the value of at least one of the following functions is calculated, said functions defining the difference in a physical and/or linguistic parameter of speech sounds:

- a context function defining the degree of similarity of speech sounds preceding and following compared speech sounds;
- an intonation function defining the correspondence of said intonation models of compared speech sounds and their position with respect to the phrasal stress;
- a fundamental pitch frequency function defining the difference of frequency of the fundamental pitch of compared speech sounds;
- a positional function defining the difference in position within the word of compared speech sounds;
- a positional function defining the difference in position within the syllable of compared speech sounds;
- a positional function defining the difference in position within the specified portion of a text of compared speech sounds, the position being defined by the number of syllables from the beginning of said portion of a text;
- a positional function defining the difference in position within the specified portion of a text of compared speech sounds, the position being defined by the number of syllables to the end of said portion of a text;
- a positional function defining the difference in position within the specified portion of a text of compared speech sounds, the position being defined by the number of stressed syllables from the beginning of said portion of a text;
- a positional function defining the difference in position within the specified portion of a text of compared speech sounds, the position being defined by the number of stressed syllables to the end of said portion of a text;
- a pronunciation function defining the degree of the correspondence between the pronunciation of a speech sound from the speech database and the ideal pronunciation of this sound according to the language rules;
- an orthographical function defining the orthographic difference of the words comprising compared speech sounds;
- a stress function defining the correspondence of stress type of compared speech sounds;

and/or the value of at least one of the following functions is calculated for each sound from the speech database which can be used in synthesis, said functions characterizing the attributes of this sound:

- a duration function defining the deviation in duration of corresponding sound from the average duration of same-name sounds in the database with regard to the phrasal stress;
- an amplitude function defining the deviation in amplitude of corresponding sound from the average amplitude of same-name sounds in the database with regard to the phrasal stress;
- a fundamental pitch maximum frequency function defining the maximum frequency of the fundamental pitch of corresponding sound;
- a fundamental pitch frequency jump function defining frequency jump of the fundamental pitch on corresponding sound;

and/or the value of at least one of the following functions is calculated for each pair of sounds from the sound database which can be used in synthesis of each subsequent pair of the target sounds, the functions defining the quality of connection between said sounds from the speech database:

- a fundamental pitch frequency connection function of corresponding pair of sounds, the function defining the relation of frequencies of the fundamental pitch at the ends of the sounds of said pair;
- a fundamental pitch frequency derivative connection function of corresponding pair of sounds, the function defining the relation of frequency derivatives of the fundamental pitch at the ends of the sounds of said pair;
- a MFCC connection function defining the relation of normalized MFCC at the ends of sounds of said pair;
- a continuity function defining whether the sounds of corresponding pair form a single fragment of a speech block.

In another embodiment of the invention, when calculating the sum of values of the functions said values are taken with different weights.

In still another embodiment of the invention, if the found most similar sound does not conform to a certain criterion, when synthesizing speech the sound is replaced by a speech sound from the database that conforms to said criterion.

DETAILED DESCRIPTION OF THE INVENTION

A method of speech synthesis according to the present invention can be realized by a speech synthesizer implemented as a software program that can be installed on a computing device, e.g. a computer.

FIG. 1 illustrates a flow chart of a speech synthesizer according to the present invention. It should be noted that, in this embodiment, the synthesizer is adapted to synthesize Russian speech. The synthesizer comprises text conversion module 1 including N submodules. Each of said submoduls is adapted to convert the text presented in corresponding encoding and/or format, e.g. unformatted text, Word-formatted text, etc., into a sequence of Russian letters and digits without extraneous symbols and codes.

Module 1 is connected to engine 2 including a sequence of submoduls, namely linguistic submodule 2-1, prosodic submodul 2-2, phonetic submodul 2-3 and acoustic submodul 2-4. Submodul 2-2 interacts with intonation database 3 containing parameters that defines a set of intonation models, and submodule 2-4 interacts with speech database 4 containing non-uniform continuous samples of natural speech and with speech sounds database 5 containing all allophones of Russian language. Herein, the term "allophone" refers to a specific implementation of a phoneme in speech, defined by the phonetic environment of the phoneme.

When synthesizing speech, the proposed synthesizer performs the following sequence of operations.

The text to be used as a basis for speech synthesis is input into the computer using standard input-output devices, e.g. a keyboard (not shown). The input text is directed to the input of module 1. Module 1 determines the encoding and/or format of the input text and, depending on said encoding and/or format, forwards the text to one of its submodules. Each of such submodules is adapted to convert specifically encoded and/or formatted text, e.g. unformatted text or Word-formatted text. The corresponding submodule of module 1 converts the formatted text into a sequence of Russian letters and digits without extraneous symbols and coded.

Such sequence is then directed to engine 2 and undergoes subsequent processing in submodules 2-1 to 2-4 of engine 2.

Submodule 2-1 performs linguistic processing of the text, in particular, separating it into words and sentences, deciphering clips, abbreviations and foreign language inserts, searching for words in a dictionary to obtain their linguistic characteristics and stress, correcting orthographic errors, converting numerals written by digits into spoken form, solving homonymic tasks, in particular selecting the stress corresponding to the context, e.g. 3Амок and 3амОк.

Submodule 2-2 determines intonation and puts pause intervals, in particular submodule 2-2 determines the type of intonation contour, i.e. the trajectory of the frequency of the voice fundamental pitch. The intonation contour may correspond, for example, to completeness, question, non-completeness, or exclamation. Submodule 2-2 also determines the position and duration of pause intervals.

Submodule 2-3 converts an orthographical text into a sequence of phonetic symbols, i.e. transforms letters of the text into corresponding phonemes. In particular, this submodule takes into account the variability of conversion, i.e. the fact that a word with the same spelling can be pronounced differently depending on the context. Further, submodule 2-3 determines required physical parameters corresponding to each phonetic symbol, e.g. frequency of the fundamental pitch, duration and energy.

Submodule 2-4 forms a sequence of speech sounds for the output speech signal. To this end, submodule 2-4 accesses database 4 and searches for most suitable speech sounds in terms of their parameters in the database. Then submodule 2-4 fits these sounds together, modifying them if necessary, e.g. changing tempo, pitch, and volume, etc.

Sound waves of a speech signal are generated by corresponding standard computer devices (not shown), e.g. a sound card or a chip on the motherboard, and an acoustic system.

The operation of submodule 2-2 is described below in more details. On the first stage, this submodule analyzes connections between words and specifies separate portions in the text based on the linguistic analysis of said text by unit 2-1, in particular the analysis of grammatical characteristics of words in the text, for example certain parts of speech, gender and number, and punctuation of the text. For example, submodule 2-2 can specify syntagms. Herein, the term "syntagm" refers to an intonationally arranged phonetic unity in speech expressing a single semantic unit. In a particular case, a text may include only one syntagm. Further, submodule 2-2 determines the intonation of each syntagm. To this end, all intonation overtones of speech were previously grouped into 13 intonation types. For each intonation type, mathematical intonation models were constructed, the models being specified by intonation contour and defined by at least one of the following parameters: inclination of the trajectory of the fundamental pitch, initial value of the fundamental pitch, terminal value of the fundamental pitch, shaping of the fundamental pitch on stressed vowels, namely on the first stressed vowel, middle stressed vowel and last stressed vowel, energy of speech sounds and law of duration variation of speech sounds. In this embodiment, allophones are speech sounds to be minimal units for speech synthesis.

Therefore, the intonation of specific syntagm is determined by associating it with one of said intonation types. Further, according to the determined intonation, an appropriate intonation model is selected for a given syntagm, a list of parameters for said model being previously stored in the database 3. Said parameters are used to determine physical parameters of target allophones corresponding to specific syntagm, i.e allophones that should be pronounced when pronouncing the syntagm correctly according to Russian language rules, as described below in details.

Furthermore, the position and duration of pause intervals in speech are determined by submodule 2-2 based on the linguistic analysis of text by submodule 2-1 and also in accordance with the determined intonation of syntagms.

Thus, submodule 2-2 outputs the text divided into syntagms and separated by pause intervals to be taken into account when synthesizing speech and intonation contour of the text, the contour being defined by specific parameters and produced by connecting intonation contours of each syntagm.

The operation of submodulet 2-3 is described below in more details.

In order to convert letters of the text into phonemes, submodule 2-3 uses transcription rules of Russian language. The context of a letter is also taken into account, i.e letters preceding said letter, and the position of said letter with respect to the stressed vowel, i.e. before or after this stressed vowel. A precomposed list of exceptions in transcription is also taken into account. For example, the word "радио" is pronounced with a stressed "a" and an unstressed "o".

After determining all target phonemes corresponding to the input text, and, thus, all target allophones for which linguistic parameters are determined such as transcription, allophones preceding and following a given allophone, the position of a given allophone with respect to the stressed vowel, submodule 2-3 determines physical parameters of each allophones. Such parameters depend on the type of the intonation contour of corresponding syntagm obtained by submodule 2-2. For example, a syntagm has been specified in the text, and it has been found that it has a questionary intonation according to model 3. Then submodule 2-3 has determined that said syntagm contains 16 allophones. In this case, submodule 2-3 accesses the database 3 comprising a list of parameters for model 3 (disclosed above with regard to the operation of submodule 2-2), and determines physical parameters of each of the 16 allophones in the syntagm based on said parameters of model 3. For example, the behavior of the fundamental pitch on each allophone can be determined based on initial and terminal values of the fundamental pitch, inclination of the trajectory of the fundamental pitch, and shaping of the fundamental pitch on stressed vowels. The duration of each allophone can be determined based on the law of the duration variation of allophones in the syntagm.

Thus, submodule 2-3 determines a set of physical parameters for each allophone of each syntagm, the parameters including at least duration of an allophone, frequency of the fundamental pitch of an allophone and energy of an allophone.

Correspondingly, sumodule 2-3 outputs a sequence of target allophones corresponding to the input text, said physical and linguistic parameters being determined for each allophone.

Such data is input to submodule 2-4, the operation of which is described below in more details.

In order to form the output speech signal, submodule 2-4 accesses database 4 and searches for allophones most similar to the target allophones corresponding to the input text and defined by unit 2-3 in terms of physical and/or linguistical parameters in natural speech samples In order to determine the most similar allophones, a cost function is calculated; the general form of such function is represented by a formula $$C(u, t) = w^t \sum_{i=1}^{n} C^t(u_i, t_i) + w^c \sum_{i=2}^{n} C^c(u_{i-1}, u_i), \tag{1}$$

where C' is a replacement cost, w' is the weight of the replacement cost, $C^c$ is a connection cost, $w^c$ is the weight of the connection cost, $t_i$ is the target allophone, $u_i$ is an allophone from the speech database 4. An allophone from the database 4 as used herein can also be referred to as "candidate allophone" or "candidate".

The replacement cost of the allophone $u_i$ from database 4 with respect to the target allophone $t_i$, is the allophones being compared by p attributes, is calculated by the formula $$C^t(u_i, t_i) = \frac{\sum_{k=1}^{p} w_k^t C_k^t(u_i, t_i)}{\sum_{k=1}^{p} w_k^t}, \tag{2}$$

where $C_k^t$ is a $k^{th}$ attribute penalty, $w_k^t$ is a $k^{th}$ attribute weight.

The attributes for the comparison can be changed if necessary. If the weight of corresponding attribute is equated to 0, the penalty of said attribute will not be taken into account when calculating the replacement cost. The replacement cost value decreases with increase in similarity between compared allophones, and reaches 0 if two allophones are compared which are identical with respect to considered attributes.

Furthermore, the equation (2) can be used to evaluate the deviation of value of one or more attributes of the allophone $u_i$ from database 4 from such attributes of some set of allophones, i.e. from the average value of a certain attribute of all allophones in database 4.

A connection cost between two allophones $u_i$ and $u_{i-1}$ in the database, the quality of the connection being determined based on q attributes, is calculated by the formula $$C^c(u_{i-1}, u_i) = \frac{\sum_{k=1}^{q} w_k^c C_k^c(u_{i-1}, u_i)}{\sum_{k=1}^{q} w_k^c}, \tag{3}$$

where $C_k^c$ is a $k^{th}$ attribute penalty, $w_k^c$ is a $k^{th}$ attribute weight.

The connection cost shows the quality of connection between two evaluated allophones when placed sequentially during synthesizing speech, i.e. how good said allophones concatenate to each other.

The attributes used to evaluate the quality of connection can be changed if necessary. If the weight of corresponding attribute is equated to 0, the penalty of said attribute will not be taken into account when evaluating the quality of connection. As the quality of connection between allophone increases, the connection cost decreases. The value of 0 usually corresponds to two sequential allophones in a natural speech sample.

The function (1) is calculated for a text fragment, e.g. for a sentence or a paragraph.

In order to compare the target allophone and an allophone from database 4 in terms of attributes defining the replacement cost, values of at least one of the functions described below can be calculated, the functions defining the difference in physical and/or linguistic parameters of the target allophone and an allophone from database 4. The values of said functions are penalties for corresponding replacement of allophones and are added as summands $C_k^t$ to equation (2).

It should be noted that values returned by the below-mentioned functions were obtained by different methods of expert estimation. Ranges of returned values are indicated for some functions, while exact values from these ranges are defined by the applied method of expert estimation.

In this embodiment of the present invention, following functions are used to determine the replacement cost.

1. A context function defining the degree of similarity of allophones preceding and following compared speech sounds.

In order to calculate the value of the function for inexact right and/or left context of the candidate allophone for synthesis, a penalty is imposed ranging from 0 to 100. Penalties for left and right context are summated and the sum is normalized to 1. The resulting value can be taken with corresponding weight.

2. An intonation function defining the correspondence of intonation models of compared allophones and the position of the allophones with respect to the phrasal stress.

In order to calculate the value of the function for replacing one intonation contour by another one, a penalty is imposed ranging from 0 to 100, and the resulting value is normalized to 1. Then the position both of the candidate allophone and the target allophone is determined with respect to the phrasal stress, namely under the phrasal stress, before the phrasal stress or after the phrasal stress. In two latter cases, a number of syllables between the allophone and the phrasal stress are determined. Then, depending on the position of the target allophone with respect to the phrasal stress, the penalty is calculated as follows:

A. If the target allophone is under the phrasal stress and
   a. the candidate is under the phrasal stress, the penalty for replacement of the intonation contour is taken as the resulting penalty;

b. the candidate is not under the phrasal stress, 1 is taken as the resulting penalty.

B. If the target allophone is after the phrasal stress and a. the candidate is under the phrasal stress, 1 is taken as the resulting penalty;

b. the candidate is before the phrasal stress, the resulting penalty is taken from the range from 0.3 to 0.7;

c. the candidate is after the phrasal stress, the resulting penalty is taken that calculated by the formula K*(penalty for replacement of the intonation contour)+min(L; (number of syllables)*M), where K is selected from the range 0.3-0.7; L is selected from the range 0.25-0.45, M is selected from the range 0.03-0.1.

C. If the target allophone is before the phrasal stress, the resulting penalty is determined similarly to B.

For a consonant, the resulting penalty is reduced by ten times. The obtained penalty can be taken with corresponding weight.

3. A fundamental pitch frequency function defining the the difference of frequency of the fundamental pitch of compared allophones. In order to calculate the value of the function, the frequency of the fundamental pitch of the candidate is compared with the predicted frequency of the fundamental pitch of the target allophone and the maximum deviation divided by 15 is returned. The resulting penalty can be taken with corresponding weight.

4. A positional function defining the difference in position within the word of compared allophones. In order to calculate the value of the function, the position within the word of the candidate is compared with the position within the word of the target allophone, with following possible positions: initial allophone, terminal allophone, allophone in the middle of the word. In the positions are mismatched, 1 is returned, otherwise, 0 is returned. The resulting value can be taken with corresponding weight.

5. A positional function defining the difference in position within the syllable of compared allophones. In order to calculate the value of the function, the position of the candidate within the syllable is compared with the position within the syllable of the target allophone, with following possible positions: initial allophone, terminal allophone, allophone in the middle of the syllable. If the positions are mismatched, 1 is returned, otherwise, 0 is returned. The resulting penalty can be taken with corresponding weight.

6. A positional function defining the difference in position within the syntagm of compared allophones, the position being defined by the number of syllables from the beginning of said syntagm. In order to calculate the value of the function, the numbers of syllables from the beginning of the syntagm to the candidate and the target allophone are compared. If the difference is 0, 0 is returned; if the difference is less than 3, or 4, or 5, or 6, a value from the range from 0.2 to 0.45 is returned; if the difference is less than 8, or 9, or 10, or 11, or 12, the value from the range from 0.5 to 0.75 is returned; if the difference is more than 7, or 8, or 9, or 10, or 11, 1 is returned. The resulting value can be taken with corresponding weight.

7. A positional function defining the difference in position within the syntagm of compared allophones, the position being defined by the number of syllables to the end of said syntagm. In order to calculate the value of the function, the numbers of syllables from the candidate allophone and the target allophone to the end of the syntagm) are compared. If the difference is 0, 0 is returned; if the difference is less than 3, or 4, or 5, or 6, a value from the range from 0.2 to 0.45 is returned; if the difference is less than 8, or 9, or 10, or 11, or 12, a value from the range from 0.5 to 0.75 is returned; if the difference is more than 7, or 8, or 9, or 10, or 11, 1 is returned. The resulting value can be taken with corresponding weight.

8. A positional function defining the difference in position within the syntagm of compared allophones, the position being defined by the number of stressed syllables from the beginning of said syntagm. In order to calculate the value of the function, the numbers of stressed syllables from the beginning of the syntagm to the candidate and the target allophone are compared. If the difference is 0, 0 is returned; if the difference is less than 2, or 3, or 4, a value from the range from 0.2 to 0.35 is returned; if the difference is less than 6, or 7, or 8, a value from the range from 0.5 to 0.75 is returned; if the difference is more than 5, or 6, or 7, 1 is returned. The resulting value can be taken with corresponding weight.

9. A positional function defining the difference in position within the syntagm of compared allophones, the position being defined by the number of stressed syllables to the end of said syntagm. In order to calculate the value of the function, the numbers of stressed syllables from the the candidate and the target allophone to the end of the syntagm are compared. If the difference is 0, 0 is returned; if the difference is less than 2, or 3, or 4, a value from the range from 0.2 to 0.35 is returned; if the difference is less than 6, or 7, or 8, a value from the range from 0.5 to 0.75 is returned; if the difference is more than 5, or 6, or 7, 1 is returned. The resulting value can be taken with corresponding weight.

10. A pronunciation function defining the degree of correspondence between the pronunciation of an allophone from database 4 by a speaker and the ideal pronunciation of this allophone according to the Russian language rules. Possible differences in pronunciation are resulted from that, in natural speech, a speaker substitutes some allophones or fuses them with neighboring allophones. In order to calculate the value of the function, the real and ideal transcriptions of the candidate are compared. In case of match, 0 is returned; if the transcriptions do not match and the allophone is reduced, 1 is returned; otherwise, i.e when transcriptions differ not only by the degree of reduction, but also by allophone name, the candidate is discarded if not taken together with neighboring allophones. The resulting value can be taken with corresponding weight.

11. An orthographical function defining the orthographic differences of words comprising compared allophones. In order to calculate the value of the function, words containing the candidate and the target allophone are compared in terms of orthography. If the words orthographically match, 0 is returned; otherwise, 1 is returned. The resulting value can be taken with corresponding weight.

12. A stress function defining the correspondence of stress type of compared allophones. In order to calculate the value of the function, the correspondence of stress type of the candidate and the target allophone is checked. Three stress types are possible: phrasal stress, logical stress and no stress. If the types match, 0 is returned; otherwise, the candidate is discarded.

Alternatively or additionally, in order to calculate the replacement cost for each allophone from database 4 that can be used in synthesis, the values of at least one function characterizing attributes of said allophone can be calculated. Values of such functions are penalties for corresponding allophone replacement, and the values are added as summands $C_k^t$ to the equation (2).

In this embodiment of the present invention, the following functions are used for this purpose.

1. A duration function defining the deviation in duration of corresponding allophone from the average duration of same-name allophones in database 4 with regard to the phrasal stress. In order to calculate the value of the function, the duration of the candidate allophone is compared with the average duration for all allophones of the corresponding phoneme in database 4 with regard to the phrasal stress, the difference being calculated with respect to the mean-square deviation. The function is piecewise linear. Salient points and obliquing factor are defined as the rows DurDeviation_x(i)=k(i), where k(i) is the obliquing factor of the right line connecting the points x(i−1) and x(i), and i is the row number in a text file. The resulting value can be taken with corresponding weight. Minimal and maximal acceptable values can be also set; if said acceptable values are exceeded, the candidate is discarded.

2. An amplitude function defining the deviation in amplitude of corresponding allophone from the average amplitude of same-name allophones in database 4 with regard to the phrasal stress. In order to calculate the value of the function, amplitude of the candidate allophone is compared with the average amplitude for all allophones of corresponding phoneme in database 4 with regard to the phrasal stress, the difference being calculated with respect to the mean-square deviation. The function is piecewise linear. Salient points and obliquing factor are defined as rows AmplDeviation_x(i)=k(i), where k(i) is the obliquing factor of the right line connecting the points x(i−1) and x(i), and i is the row number in a text file. The resulting value can be taken with corresponding weight. Minimal and maximal acceptable values can be set; if said acceptable values are exceeded, the candidate is discarded.

3. A fundamental pitch maximum frequency function defining the maximum value of the frequency of the fundamental pitch of corresponding allophone. In order to calculate the value of the function, the maximum value is determined based on the values of the frequency of the fundamental pitch of the candidate. If the determined value does not exceed a threshold, 0 is returned, otherwise, the candidate is discarded.

4. A fundamental pitch frequency jump function defining the frequency jump of the fundamental pitch of corresponding allophone. In order to calculate the value of the function, the frequency jump of the fundamental pitch is determined based on the values of the frequency of the fundamental pitch of the candidate. If said the determined value does not exceed a threshold, 0 is returned, otherwise, the candidate is discarded.

Alternatively or additionally, in order to calculate the connection cost between two subsequent allophones, for each pair of allophones from database 4 that can be used for synthesizing each subsequent target pair of allophones corresponding to each synthagm, at least one function can be calculated, the function defining the quality of connection between said pair of allophones from database 4. The values of these functions are penalties for using said pair of allophones from database 4 in speech synthesis. Said values are included into the equation (3) as summands $C_k^c$.

In this embodiment of the present invention, the following functions are used for this purpose.

1. A fundamental pitch frequency connection function of a pair of allophones, the function defining the relation of frequency of the fundamental pitch at the ends of the allophones of the pair. In order to calculate the value of the function, the frequencies of the fundamental pitch at the ends of the allophones to be connected are compared, and the difference of said frequencies divided by the threshold JoinF0Threshold is returned. The resulting value can be taken with corresponding weight. If the difference is greater than the threshold, an additional penalty is added to the value of the function.

2. A fundamental pitch frequency derivative connection function of a pair of allophones, the function defining the relation of frequency derivative of the fundamental pitch at the ends of the allophones of the pair. In order to calculate the value of the function, the frequency derivatives of the fundamental pitch at the ends of the allophones to be connected are compared, and the difference of said frequency derivatives divided by the threshold JoinDF0Threshold is returned. The resulting value can be taken with corresponding weight. If the difference is greater than the threshold, an additional penalty is added to the value of the function.

3. A MFCC connection function defining the relation of normalized MFCC at the ends of the allophones of said pair.

A spectral envelope can be described using MFCC (Mel-frequency cepstral coefficients). Each allophone is characterized by a left frequency spectrum (i.e. at the beginning thereof), and a right frequency spectrum (i.e. at the end thereof). If two allophones are taken from a phrase of natural speech in succession, the right spectrum of the first allophone is completely identical to the left spectrum of the second allophone. In order to calculate the values of the function, normalized MFCC at the ends of the allophones to be connected are compared. In this embodiment of the present invention, 20 MFCC's are used. In order to calculate the difference of two vectors, each containing 20 coefficients, Euclidean metric is used according to which the difference of two vectors, each containing 20 coefficients, can be calculated by the following formula:

$$d(x, y) = \sqrt{(x_1 - y_1)^2 + (x_2 - y_2)^2 + \ldots + (x_n - y_n)^2} = \sqrt{\sum_{k=1}^{n} (x_k - y_k)^2}. \quad (4)$$

where $x_n$ is the coordinates of one MFCC vector, $y_n$ is the coordinates of another MFCC vector, and n=20. The resulting value can be taken with corresponding weight.

4. A continuity function defining whether the allophones of corresponding pair form a single fragment of a speech block. If the allophones to be connected do not constitute a single fragment of a speech block, a previously determined value is returned; otherwise, 0 is returned. The resulting value can be taken with corresponding weight.

Thus, submodule 2-4 forms a sequence of allophones from database 4, for which allophones for each text fragment (e.g. a sentence or a paragraph) cost function (1) has the minimal value. Using corresponding standard computer devices, e.g. a sound card or a chip on the motherboard and an acoustic system, a sound wave of speech signal is generated based on the sequence of allophones output by submodule 2-4. Due to the method of speech synthesis implemented in the synthesizer according to the present invention which takes into account a plurality of physical and linguistic parameters of the target allophones corresponding to the input text and allophones from database 4, allophones optinal in terms of parameters from database 4 are used for synthesis. On the other hand, ceteris paribus the speech synthesizer according to the present invention selects maximally long natural speech units from database 4 for synthesis because this minimizes replacement cost function (2). This provides a synthesized speech of high quality and similar to natural speech.

Additionally, the synthesizer is adapted to access database 5 comprising all allophones of the language, if none of the allophones from database 4 (including the allophone most similar in terms of parameters to the target allophone) meet a certain criterion. In this case, when synthesizing speech, the synthesizer, instead of using said most similar allophone in terms of parameters from database 4, uses for synthesizing corresponding target allophone a same-name allophone from database 5. For example, said criterion can be an exact match in phonetic environment of the target allophone and candidate. If database 4 does not comprise an allophone with phonetic environment identical to the phonetic environment of the target allophone, the synthesizer accesses database 5 and uses an allophone with identical phonetic environment found therein. For example, if the allophone "И" is required for synthesis, the allophone having the sound "C" on the left and the sound "M" on the right, the synthesizer searches for the allophone "cИм" in database 4. If such allophone is not found in database 4, the synthesizer uses corresponding allophone from database 5.

In the above description, the principles of the invention are presented by means of a preferred embodiment thereof. However, those skilled in the art will appreciate that other embodiments of the present invention are possible and changes and modifications can be made within the spirit and scope of the invention defined by the annexed claims.

I claim:

1. A method of computerized text-based speech synthesis, wherein at least one portion of a text is specified;

the intonation of each portion is determined;

target allophones are associated with each portion;

physical parameters of the target allophones are determined, by a computing device, for each of the target allophones;

allophones most similar to the target allophones in terms of said physical parameters are found in a speech database;

speech is synthesized as a sequence of the found allophones, wherein the physical parameters of the target allophones are determined according to the determined intonation.

2. A method according to claim 1 wherein linguistic parameters of the target allophones are further determined and when the allophones are searched for in the speech database, allophones most similar to the target allophones also in terms of said linguistic parameters are found in the speech database.

3. A method according to claim 2, wherein the linguistic parameters of an speech sound allophone include at least one of the following parameters: transcription, allophones preceding and following said allophone; the position of said allophone with respect to the stressed vowel.

4. A method according to claim 1, wherein the at least one portion of a text is specified based on grammatical characteristics of words in the text and punctuation in the text.

5. A method according to claim 1, wherein at least one preconstructed intonation model is selected according to the determined intonation, said model being defined by at least one of the following parameters: inclination of the trajectory of the fundamental pitch, shaping of the fundamental pitch on stressed vowels, energy of allophones and law of duration variation of allophones, and the physical parameters of the target allophones are determined based on at least one of said parameters of corresponding model.

6. A method according to claim 5, wherein shaping of the fundamental pitch on stressed vowels includes shaping on the first stressed vowel and/or middle stressed vowel and/or last stressed vowel.

7. A method according to claim 5, wherein said physical parameters of allophones include at least duration of allophones, frequency of the fundamental pitch of allophones and energy of allophones.

8. A method according to claim 1, wherein the most similar allophones are determined by calculating the value of at least one function defining the difference in physical and/or linguistic parameters of the target allophone and an allophone from the speech database, and/or by calculating the value of at least one function for each allophone from the speech database which can be used in synthesis, said function characterizing the attributes of this allophone, and/or by calculating the value of at least one function for each pair of allophones from the allophones database which can be used in synthesis of each subsequent pair of the target allophones, said function defining the quality of connection between said pair of allophones from the speech database, wherein said most similar allophones are determined as allophones forming a sequence to synthesize a predetermined fragment of said text, for which sequence the sum of calculated values of said functions is minimal.

9. A method according to claim 8, wherein the predetermined fragment of the text is a sentence or a paragraph.

10. A method according to claim 8, wherein the value of at least one of the following functions is calculated, said functions defining the difference in a physical and/or linguistic parameter of speech allophones:

a context function defining the degree of similarity of allophones preceding and following compared allophones;

an intonation function defining the correspondence of said intonation models of compared allophones and their position with respect to the phrasal stress;

a fundamental pitch frequency function defining the difference of frequency of the fundamental pitch of compared allophones;

a positional function defining the difference in position within the word of compared allophones;

a positional function defining the difference in position within the syllable of compared allophones;

a positional function defining the difference in position within the specified portion of a text of compared allophones, the position being defined by the number of syllables from the beginning of said portion of a text;

a positional function defining the difference in position within the specified portion of a text of compared allophones, the position being defined by the number of syllables to the end of said portion of a text;

a positional function defining the difference in position within the specified portion of a text of compared allophones, the position being defined by the number of stressed syllables from the beginning of said portion of a text;

a positional function defining the difference in position within the specified portion of a text of compared allophones, the position being defined by the number of stressed syllables to the end of said portion of a text;

a pronunciation function defining the degree of the correspondence between the pronunciation of an allophone from the speech database and the ideal pronunciation of this allophone according to the language rules;

an orthographical function defining the orthographic difference of the words comprising compared allophones;

a stress function defining correspondence of stress type of compared allophones;

and/or wherein the value of at least one of the following functions is calculated for each allophone from the speech database which can be used in synthesis, said functions characterizing the attributes of this allophone:

a duration function defining the deviation in duration of corresponding allophone from the average duration of same name allophones in the database with regard to the phrasal stress;

an amplitude function defining the deviation in amplitude of corresponding allophones from the average amplitude of same-name allophones in the database with regard to the phrasal stress;

a fundamental pitch maximum frequency function defining the maximum frequency of the fundamental pitch of corresponding allophone;

a fundamental pitch frequency jump function defining frequency jump of the fundamental pitch on corresponding allophone;

and/or wherein the value of at least one of the following functions is calculated for each pair of allophones from the allophones database which can be used in synthesis of each subsequent pair of the target allophones, the functions defining the quality of connection between said allophones from the speech database:

a fundamental pitch frequency connection function of corresponding pair of allophones, the function defining the relation of frequencies of the fundamental pitch at the ends of the allophones of said pair;

a fundamental pitch frequency derivative connection function of corresponding pair of allophones, the function defining the relation of frequency derivatives of the fundamental pitch at the ends of the allophones of said pair;

a MFCC connection function defining the relation of normalized MFCC at the ends of allophones of said pair;

a continuity function defining whether the allophones of corresponding pair from a single fragment of a speech block.

11. A method according to claim 8, wherein when calculating the sum of values of functions said values are taken with different weights.

12. A method according to claim 8, wherein if the found most similar allophone does not conform to a certain criterion, when synthesizing speech the allophone is replaced by an allophone from the database that conforms to said criterion.

13. A text-based speech synthesizer comprising a speech database containing allophones;

a specifying module configured to specify at least one portion of a text;

an intonation determining module configured to determine the intonation of each of the at least one portion;

a target allophone associating module configured to associate target allophones with each of the at least one portion;

a target allophone associating module configured to associate target allophones with each of the at least one portion;

a physical parameter determining module configured to determine physical parameters of the target allophones for each of the target allophone;

an allophone forming module configured to search for allophones most similar to the target allophones in terms of said physical parameters in the speech database and form a sequence of allophones for an output speech signal on the basis of the allophones found in the database; and speech signal generating module configured to generated the output speech signal on the basis of the formed sequence of allophones, wherein the physical parameter determining module are configured to determine said physical parameters of the target allophones on the basis of the intonation determined by the intonation determining module.

14. The text-based speech synthesizer according to claim 13 further comprising a linguistic parameters determining module configured to determine linguistic parameters of the target allophones, wherein the allophone forming module are further configured to search for allophones in the speech database most similar to the target allophones also in terms of said linguistic parameters.

* * * * *